United States Patent [19]

Griffiths

[11] 4,101,726

[45] Jul. 18, 1978

[54] WATER COOLING JACKET FOR INDUCTION FURNACE WATER BUSHING

[75] Inventor: Bernard L. Griffiths, Susuin, Calif.

[73] Assignee: Atlas Foundry & Mfg. Co., Richmond, Calif.

[21] Appl. No.: 760,185

[22] Filed: Jan. 17, 1977

[51] Int. Cl.[2] ..... H05B 5/14

[52] U.S. Cl. ..... 13/29

[58] Field of Search ..... 13/29, 30

[56] References Cited

U.S. PATENT DOCUMENTS 2,473,311 6/1949 Tama et al. ..... 13/29 X 3,297,811 1/1967 Kugler ..... 13/29

FOREIGN PATENT DOCUMENTS 2,125,768 5/1971 Fed. Rep. of Germany ..... 13/29

*Primary Examiner*—R. N. Envall, Jr.

*Attorney, Agent, or Firm*—Harris Zimmerman

[57] ABSTRACT

A water jacket positioned adjacent a water cooled bushing in an induction melting furnace. The water jacket permits cooling water to circulate adjacent the spacer in the bushing, and serves to protect the spacer from leaking molten metal.

9 Claims, 3 Drawing Figures

FIG_1
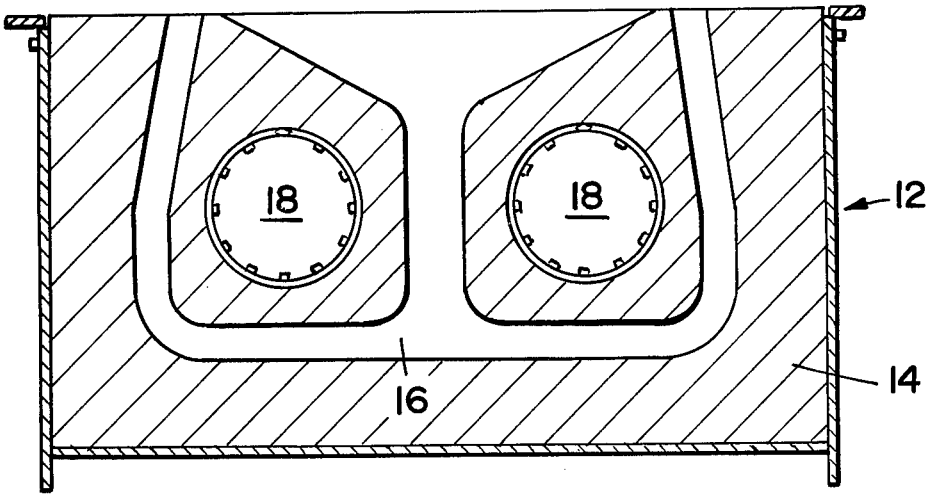
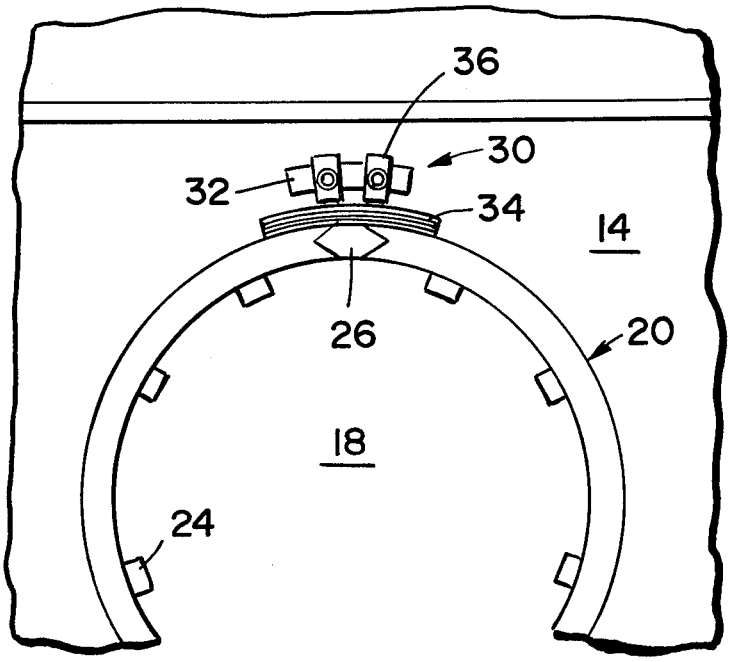
FIG_2
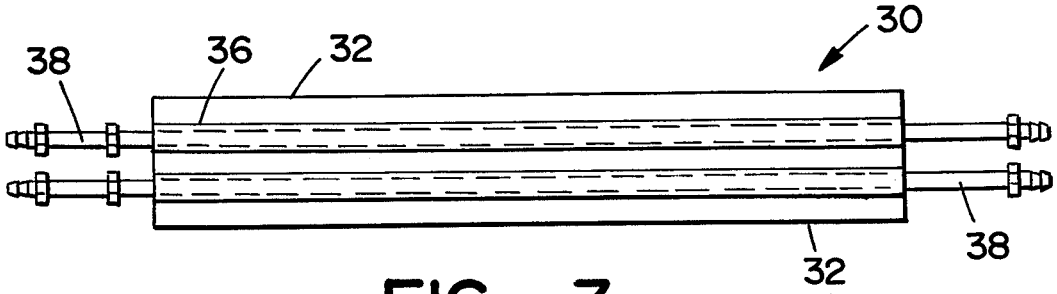
FIG_3

WATER COOLING JACKET FOR INDUCTION FURNACE WATER BUSHING

BACKGROUND OF THE INVENTION

Induction furnaces for melting iron or other metals are well known in the art. In broad terms, the iron is melted in a passageway generally surrounded by refractory material. An opening is provided in the refractory material to receive the transformer, i.e., the core and coil which creates the current for heating and melting the iron. The transformer is protected from molten metal leaking through the refractory material by a water cooled bushing disposed in the opening and surrounding the transformer.

The bushing is of generally cylindrical configuration having a longitudinally extending slot in which a transite spacer or gasket is disposed. Although the water-cooled metal of the bushing is reasonably adequate in preventing leaking molten metal from undesirably reaching the transformer, the transite spacer is not sufficiently protected, and hence can be attacked by molten metal, and permit molten metal to leak onto the transformer, resulting in substantial damage and shut-down or repair time.

SUMMARY OF THE INVENTION

In accordance with the present invention, the life of the furnace is materially and substantially enhanced and increased by protecting the transite spacer so that its life and efficiency is substantially the same as that of the bushing and/or the refractory material. This is accomplished by providing a special water jacket overlying the spacer which serves to maintain the spacer reasonably cool and avoid passage of molten metal therethrough.

THE DRAWINGS

FIG. 1 is a cross-sectional view of a portion of a generally conventional induction furnace, generally referred to in the trade as an inductor;

FIG. 2 is an enlarged view of a portion of the furnace shown in FIG. 1, with the water jacket of the present invention positioned therein.

FIG. 3 is a top plan view of the water jacket.

DESCRIPTION OF THE PREFERRED EMBODIMENT

As hereinabove stated, the jacket of the present invention is intended for use in a typical induction furnace 12, as illustrated in FIG. 1. In general, inductor 12 includes a mass of refractory material 14, defining a hearth or passageway 16 in which the iron is melted.

Extending generally horizontally through the furnace is one or more cylindrical openings 18, in which the transformer (not shown) is positioned. A conventional transformer usually includes a core and a surrounding coil, and which produces a current sufficient to melt the iron in passageway 16.

In order to protect the transformer against the danger of molten metal working through the refractory mass 14 and entering the transformer cavity 18, there is frequently provided a generally cylindrical bushing 20 formed of solid copper or the like, and which defines the opening 18. Attached to the inner surface of bushing 20 are a plurality of tubes 24 through which cooling water is circulated during operation of the inductor, so as to increase the rate of cooling of the refractory immediately surrounding the bushing. The tubing 24 extends exteriorly of the furnace for connection to suitable inlet and outlet sources, not shown, since they form no part of the present invention.

The longitudinally extending gap defining the opposed edges of the bushing is provided with a transite spacer or gasket 26 which prevents any passage of current through the bushing edges and seals the opening 18.

It may be appreciated that normally the spacer 26 is in direct contact with the surrounding or adjacent refractory material, and will leak molten metal to the opening 18, and to the transformer therein, if such molten metal contacts the spacer.

To prevent the foregoing from happening, there is provided a water jacket 30 generally overlying the spacer 26 and provided with circulating water or other coolant to protect the spacer.

The jacket 30 extends for the length of the spacer and is generally arcuate in cross-section, having a radius of curvature substantially the same as that of the bushing 20. The longitudinally extending edges 32 of the jacket extend laterally beyond the edges of spacer 26, and interposed between the jacket and spacer is a plurality of layers of mica 34, or comparable insulating material. The mica prevents coupling from the transformer in the electrical field between the bushing and the water jacket. if desired, to avoid the presence of air gaps between the jacket and the bushing, a plastic refractory of high purity, high density alumina is placed on the undersurface of the jacket before placing it in position overlying the bushing. It will be understood that the provision of the alumina, the mica layers, and the jacket, and the positioning thereof over the bushing, is effected prior to the placing of the refractory mass 14 in the inductor.

Referring again to the jacket 30, it is preferably formed of a metal with good thermal conductivity, such as copper, and is provided with one or more water circulating channels 36 extending for the length of the jacket. Suitable water inlet and outlet pipes 38 are provided to effect ingress and egress of cooling water through the jacket.

With the above arrangement, it will be understood that the cooling jacket effectively protects the spacer 26 from molten metal which might otherwise reach the same, such as by leakage or seepage through the refractory material.

I claim:

1. In an induction melting furnace which includes a hearth, a passage through said hearth surrounded by refractory material, an induction transformer disposed in said passage, a bushing lining said passage, and having a longitudinally extending gap, a gasket element sealing the gap, and cooling liquid means associated with said bushing, the improvement comprising a water jacket overlying said gasket element, and means for circulating water through said jacket.

2. The apparatus of claim 1 in which electrical insulating material is interposed between said gasket element and said water jacket.

3. The apparatus of claim 2 in which said electrical insulating material comprises mica.

4. The apparatus of claim 2 in which said electrical insulating material comprises a plurality of layers of mica.

5. The apparatus of claim 1 in which said water jacket includes a member having a cross-sectional curvature substantially the same as the curvature of said bushing and positioned in parallel spaced relation thereto.

6. The apparatus of claim 5 in which said member is formed of copper, and said water circulating means includes water channels extending along the length thereof.

7. The apparatus of claim 6 including a plurality of mica layers positioned between said gasket and said member.

8. The apparatus of claim 1 in which said water bushing includes means for circulating water therethrough, said gasket element is formed of transite, and said water jacket extends laterally beyond the opposed edges of said bushing defining said gap.

9. The apparatus of claim 8 including an electrical insulating layer interposed between said gasket and said water jacket.

* * * * *